US007473288B2

(12) United States Patent
Toyoda et al.

(10) Patent No.: US 7,473,288 B2
(45) Date of Patent: Jan. 6, 2009

(54) PARTICULATE MATTER REDUCING APPARATUS

(75) Inventors: Tetsuro Toyoda, Nishitokyo (JP); Katsunori Matsuoka, Ome (JP)

(73) Assignee: Clean Diesel Technologies, Inc., Stamford, CT (US)

( * ) Notice: Subject to any disclaimer, the term of this patent is extended or adjusted under 35 U.S.C. 154(b) by 405 days.

(21) Appl. No.: 10/883,555

(22) Filed: Jul. 1, 2004

(65) Prior Publication Data

US 2005/0132674 A1 Jun. 23, 2005

(30) Foreign Application Priority Data

Dec. 18, 2003 (JP) ..... 2003-420439

(51) Int. Cl.
*B01D 46/02* (2006.01)
*F01N 3/023* (2006.01)

(52) U.S. Cl. ..... 55/282.3; 55/282.2; 55/385.3; 55/482; 55/484; 55/498; 55/510; 55/524; 55/525; 55/527; 55/DIG. 10; 55/DIG. 30; 60/297; 60/299; 60/303; 60/311

(58) Field of Classification Search ..... 55/282.2, 55/282.3, 385.3, 482, 484, 498, 510, 523, 55/524, 525, 527, DIG. 10, DIG. 30; 60/278, 60/297, 299, 300, 303, 311; 423/213.2, 213.5
See application file for complete search history.

(56) References Cited

U.S. PATENT DOCUMENTS 3,989,471 A * 11/1976 Nowak ..... 60/299
4,329,162 A 5/1982 Pitcher, Jr.
4,374,803 A * 2/1983 Fratzer et al. ..... 422/176
4,385,032 A 5/1983 Fratzer
4,419,113 A * 12/1983 Smith ..... 55/DIG. 10
4,813,231 A * 3/1989 Bykowski ..... 55/523
4,913,712 A * 4/1990 Gabathuler et al. .... 55/DIG. 30
4,914,070 A 4/1990 Ledoux et al.
5,042,249 A 8/1991 Erdmannsdoerfer
5,141,714 A * 8/1992 Obuchi et al. ..... 60/303
5,195,319 A * 3/1993 Stobbe ..... 55/523
5,293,742 A * 3/1994 Gillingham et al. ..... 60/311
5,458,664 A * 10/1995 Ishii et al. ..... 55/DIG. 10
5,484,575 A 1/1996 Steenackers (Continued)

FOREIGN PATENT DOCUMENTS

EP 0 220 505 A2 9/1986

(Continued)

*Primary Examiner*—Jason M Greene
(74) *Attorney, Agent, or Firm*—Thaddius J. Carvis

(57) ABSTRACT

This particulate matter reducing apparatus 10 is provided to burn and reduce particulate matter ("PM") in an exhaust gas 1 of a diesel engine while collecting the PM on each filter 11 at a low collection rate of 50% or less in total. The filter 11 is composed of a wire mesh structure and is formed in a short column shape provided with a central through hole 12. The filter 11 is coaxially housed in an outer cylindrical casing 4 with a gap 14 provided within the casing and is retained by a pair of front and rear shielding plates 17 and 18. The pair of shielding plates 17 and 18 divides the inside of the outer cylindrical casing 4 in front and rear and is provided with one or more air holes 15 and 16 at the outer circumferential section or at the central section.

7 Claims, 5 Drawing Sheets

U.S. PATENT DOCUMENTS

| | | | | | |
|---|---|---|---|---|---|
| 5,557,923 | A | * | 9/1996 | Bolt et al. | 60/311 |
| 5,571,298 | A | * | 11/1996 | Buck | 55/282.3 |
| 5,682,740 | A | * | 11/1997 | Kawamura | 60/311 |
| 6,387,143 | B1 | * | 5/2002 | Adiletta | 55/498 |
| 6,572,682 | B2 | * | 6/2003 | Peter et al. | 55/282.3 |
| 7,108,739 | B2 | * | 9/2006 | Iyer et al. | 55/282.3 |
| 2002/0128151 | A1 | | 9/2002 | Galligan | |

FOREIGN PATENT DOCUMENTS

| | | | | |
|---|---|---|---|---|
| EP | 0 313 480 | | | 4/1989 |
| EP | 1 262 641 | A1 | * | 12/2002 |
| EP | 1262641 | B1 | | 12/2002 |

* cited by examiner

PARTICULATE MATTER REDUCING APPARATUS

BACKGROUND OF THE INVENTION

1. Field of the Invention

The present invention relates to an apparatus for reducing particulate matter. More particularly, the present invention relates to a particulate matter reducing apparatus which can collect, burn and reduce the particulate matter contained in an exhaust gas of a diesel engine. For example, the present invention relates to a reducing apparatus which can be additionally mounted later on an existing car which is being used.

2. Description of the Art

An exhaust gas of a diesel engine contains CO, HC, NOx, Particulate matter and the like. If directly discharged to the open air, these are harmful to the human body and the environment. It is therefore an important theme to reduce these harmful substances.

The present invention therefore relates to a particulate matter reducing apparatus for reducing the particulate matter among these harmful substances.

FIG. 5 is an explanatory cross-sectional view of a conventional particulate matter reducing apparatus and the like of this kind. An exhaust gas purifier 3 is connected to an exhaust pipe 2 of exhaust gas 1 discharged from a diesel engine. This exhaust gas purifier 3 is provided with a purifier 5 and a particulate matter reducing apparatus 6 within an outer cylindrical casing 4 in that order.

The purifier 5 on the upstream side is composed of a honeycomb core of which the wall of each cell is coated with an oxidation catalyst 7. The purifier 5 burns and reduces CO and HC in the exhaust gas 1 by oxidation and oxidizes NO to NO2. The particulate matter reducing apparatus 6 on the downstream side burns and reduces the particulate matter in the exhaust gas 1 by oxidation.

As is well known, the diesel engine is in a lean and excess air condition, i.e., in an excess oxygen condition in an air fuel ratio compared with a gasoline engine, wherein NO in the exhaust gas 1 can hardly be deoxidized. In addition, NO and the particulate matter in the exhaust gas 1 are in a trade-off relation, wherein the higher the burning temperature of the diesel engine, the higher the former and the lower the latter.

As the particulate matter reducing apparatus 6 for burning and reducing the particulate matter in the exhaust gas 1 of the diesel engine, there is an apparatus of a type in which an oxidation catalyst us used. However, a high-performance type using a filter 8 as shown in FIG. 5 is widely used.

The particulate matter reducing apparatus 6 using this filter 8 is also referred to as a diesel particulate filter (hereinafter referred to as "DPF"). In the particulate matter reducing apparatus 6, the particulate matter is first collected on a filter 8, then burned and reduced. By burning and eliminating the particulate matter, the filter 8 can be regenerated.

As the particulate matter reducing apparatus 6 of such a DPF type, various kinds of high-density porous filters 8 have been developed and used.

It is structurally typical to coaxially house a filter 8 of a wall-flow type in an outer cylindrical casing 4 in the same diameter and cross-sectional area as the outer casing 4. This filter 8 is provided with many air holes divided by many thin walls in the flow direction and the inlet and outlet of each air hole is alternately sealed. When the exhaust gas 1 introduced into each air hole passes through the numerous pores of the thin wall, the particulate matter contained in the exhaust gas 1 is first collected on the pores of the thin wall, then, reduced by burning.

The particulate matter consist of about the size of several μm in a primary particle condition, but these are usually interconnected in a secondary particle condition of about the size of several hundred μm. Since the diameter of numerous pores of the thin wall of the filter 8 is small with about the size of 10 μm~100 μm, almost all the particulate matter has been collected.

As the material of such a thin wall of a wall-flow typed filter 8, cordierite (which is made by hardening $Al_2O_3$ and $Si_2O_3$ by a binder), SiC, or various other ceramics are typically used.

It is to be noted that the particulate matter reducing apparatuses 6 of various other DPF types have also been developed or used. For example, a particulate matter reducing apparatus 6 has been developed or used, in which NO in the exhaust gas 1 is oxidized to $NO_2$ by an oxidation catalyst 7 and the obtained $NO_2$ promotes the burning of the particulate matter collected on the filter 8.

A filter of a wall-flow type made of ceramics, a filter made of foamed ceramics, a filter made of ceramic fiber, a filter of wire-mesh structure or the like is available as the filter 8. Such a filter has been coaxially housed in an outer cylindrical casing 4 of the same diameter and cross-sectional area as the outer casing 4.

A conventional wall-flow typed particulate matter reducing apparatus 6 is disclosed in the following patent documents 1 and 2:

[Patent Document 1] Specification of U.S. Pat. No. 4,329,162

[Patent Document 2] Specification of European Patent No. 31348

However, the following problems are pointed out concerning such a conventional particulate matter reducing apparatus 6.

<First Problem>

First, conventional particulate matter reducing apparatuses 6 of a DPF type have adopted different methods for collecting a large amount of particulate matter on the filter 8, respectively.

As described above, the typically used wall flow type filter 8 consists of a method whereby almost all the particulate matter has been collected, wherein the collection rate was 90% or more. Even the other filters 8 have adopted methods of a high collection rate in which the collection rate is 50% or more.

In use of such a filter 8, the following problems have been pointed out. Since particulate matters of more than the allowable amount or collection limit have been collected on the filter 8, the filter 8 is readily clogged with the collected particulate matter. For regeneration, the filter 8 must be cleaned up with extremely high frequency. In particular, clogging has intensively and biasedly occurred in the vicinity of an intake surface section on the upstream side of the filter 8.

Further, problems have been pointed out in that the filter 8 must be cleaned up, for example, once a day, the cleaning takes a lot of time and it is troublesome, and regeneration of the filter 8 is not easy.

For regeneration of such a filter 8, a method for incorporating an electric heater into the filter 8, a method for taking the filter 8 out and bringing it into a heating furnace, a method for alternately regenerating the heater 8 or the like has been developed and used to burn and eliminate the particulate matter collected in large quantity. However, there was a drawback in that these methods cost a great amount for the equipment and the running cost becomes high.

<Second Problem>

Second, in the conventional particulate matter reducing apparatus of a DPF type, a high-density porous filter 8 is coaxially housed in the outer cylindrical casing of the same diameter and cross-sectional area as the outer casing. In this case, the area of the intake and exhaust surface of the filter 8 is small. For example, the suction and exhaust surface have the same area as the cross-section of the outer cylindrical casing 4. In use, the conventional filter 8, structurally, has a large resistance to the flow of the exhaust gas 1. Thus, a larger resistance is generated by friction and the like and there is a large pressure loss in the exhaust gas 1.

In addition, as described above, the conventional filter 8 has shown a high collection rate of, for example, 90% or more and at least, 50% ore more. Thus, the resistance to the flow of exhaust gas 1 becomes even larger because of the collected particulate matter. In particular, the resistance and the pressure loss have become larger as the collection advances to come close to the clogging conditions. This becomes intensively and biasedly marked in the vicinity of the intake surface section on the upstream side of the filter 8.

It has been pointed out that the back pressure of the exhaust gas 1 within an exhaust pipe 2 on the upstream side of the filter 8 rises according to generation of the resistance and the pressure loss in such a filter 8 and the increase of back pressure has a bad influence on an engine disposed further upstream. Namely, it has been pointed out that the back pressure increase puts an excessive load on the engine to excessively increase the driving torque, thereby worsening the fuel consumption and increasing the incidence rate and the content by percentage of the particulate matter in the exhaust gas 1.

<Third Problem>

Third, the filter 8 of the conventional particulate matter reducing apparatus 6 of a DPF type has shown a high collection rate as described above.

It has been pointed out that the temperature of the filter 8 rises suddenly because the particulate matter collected and retained on the filter 8 in large quantities catches fire and burns at one time, and the filter 8 is in danger of melting by the high temperature or of being damaged by heat. In the case of the filter 8 made of the cordierite described above, the binder easily melts away. Further, such a problem intensively and biasedly occurs in the vicinity of the suction surface section on the upstream side of the filter 8.

In this manner, in use, the filter 8 easily melts or is damaged by heat. Sometimes, the filter 8 becomes unusable, for example, in about a week. Thus, it has been pointed out that it is difficult to regeneratively use the filter 8, the filter 8 has a problem in durability, its life is short, and it is difficult to bear the cost.

A particulate matter reducing apparatus of the present invention was developed to solve the foregoing problems of the conventional examples in view of such actual conditions and is characterized in that one or more filters have been adopted in combination with each of the following:

That is, a wire mesh structure; a short column shape with one central through hole; a coaxial arrangement within an outer cylindrical casing; a pair of shielding plates with one or more air holes; the diameter and filling density of a wire; a low collection rate; a wire of which the main component is Fe; an oxidation catalyst; a fuel borne catalyst, etc.

It is therefore an object of the present invention to provide an improved particulate matter reducing apparatus in which first, a filter is barely clogged and the trouble of cleaning can be saved; second, increase of the back pressure can be controlled to avoid a bad influence on a diesel engine; third, the filter is in no danger of melting or being damaged by heat; fourth, these conditions can be readily realized; and fifth, a high reduction and purification rate can be attained.

SUMMARY OF THE INVENTION

A technical means of the present invention for solving the problems of the prior art described above is described below. First, a particulate matter reducing apparatus according to claim 1 is as follows:

(Claim 1)

A particulate matter reducing apparatus of claim 1 is provided to burn and reduce particulate matter contained in an exhaust gas of a diesel engine while collecting it on one or more filters.

The filter is composed of a wire mesh structure and is formed in a short column shape provided with a central through hole. The filter is coaxially housed in an outer cylindrical casing connected to an exhaust pipe of the exhaust gas and is retained by a pair of front and rear shielding plates with one or more air holes while having a gap provided between the outer circumferential surface of the filter and the outer cylindrical casing.

The filter causes the exhaust gas to flow between the outer circumferential surface of the filter and the inner circumferential surface thereof and is provided to set the collection of the particulate matter at a low collection rate of 50% or less in total.

(Claim 2)

In the particulate matter reducing apparatus according to claim 1, the filter is composed of a wire mesh structure which is mesh aggregates of a metal wire, wherein a plurality of filters is axially superposed (for lamination) and is regenerated by burning and eliminating the collected particulate matter.

Each filter is provided in such a manner that the diameter of the wire is between 0.2 mm and 0.8 mm, the filling density of the wire is between 10% and 40%, and the collection rate of the particulate matter is set between 20% and 50% in total by selection of the number of superpositions (laminations) corresponding to the quantity of the exhaust gas.

(Claim 3)

In the particulate matter reducing apparatus according to claim 2, each filter is provided to obtain a filter surface area necessary for a predetermined collection rate by selecting a larger value from a range of numerical values as the wire diameter and by selecting a smaller figure from a range of numerical values as the filling density of the wire, whereby the number of superpositions (laminations) becomes greater.

(Claim 4)

In the particulate matter reducing apparatus according to claim 3, each filter is provided in such a manner that a diameter of the central through hole is close to or larger than that of the exhaust pipe and is smaller than half the outer diameter of the filter.

(Claim 5)

In the particulate matter reducing apparatus according to claim 2, the pair of front and rear shielding plates divides the inside of the outer cylindrical casing in front and rear, respectively.

One shielding plate is provided at its outer circumferential section with one or more air holes open to the gap. The other shielding plate is provided at its central section with one air hole open to the central through hole of the filter.

(Claim 6)

The particulate matter reducing apparatus according to claim 5 is provided, in which one shielding plate is provided on the upstream side, while the other shielding plate is provided on the downstream side.

The outer circumferential surface of the filter serves as an intake surface for the exhaust gas and the inner circumferential surface serves as an exhaust surface for the exhaust gas, wherein the exhaust gas is dispersed to flow through the filter from the outside to the inside thereof, whereby the particulate matter is evenly collected on each filter.

(Claim 7)

The particulate matter reducing apparatus according to claim 5 is provided, in which one shielding plate is provided on the downstream side, while the other shielding plate is provided on the upstream side.

The inner circumferential surface of the filter serves as an intake surface for the exhaust gas and the outer circumferential surface thereof serves as an exhaust surface for the exhaust gas, wherein the exhaust gas is dispersed to flow through each filter from the inside to the outside thereof, whereby the particulate matter is evenly collected on each filter.

(Claim 8)

In the particulate matter reducing apparatus according to claim 5, each filter is made of a wire of which the main component is Fe and promotes burning of the collected particulate matter utilizing the function of Fe as an oxidation catalyst.

(Claim 9)

In the particulate matter reducing apparatus according to claim 8, each filter is provided, in which the wire surface is coated with an oxidation catalyst of precious metal through a washcoat. The oxidation catalyst increases the surface area of each filter to promote collection of the particulate matter on each filter and to promote the burning of the particulate matter collected on the filter.

(Claim 10)

The particulate matter reducing apparatus according to claim 8 is provided, in which a fuel borne catalyst selected from or combined with Pt, Ce, Fe and the like can be supplied to a fuel tank of the diesel engine. The fuel borne catalyst then promotes the burning of particulate matter collected on each filter.

<Operation>

Operation of the particulate matter reducing apparatus according to the present invention will be described below.

(1) An exhaust gas from a diesel engine passes through a filter of a wire mesh structure.

(2) A filter is formed in a short column shape with one central through hole and in many cases, a plurality of filters is axially superposed (for lamination). The filter is made of a wire of which the main component is Fe and the wire is coated with an oxidation catalyst. The diameter of the central through hole is close to or larger than that of an exhaust pipe. The collection rate of particulate matter is set between 20% and 50% in total by a combination selection of the diameter and filling density of the wire and by selection of the number of filter superpositions (laminations).

Such a filter is coaxially housed in an outer cylindrical casing and is retained by a pair of front and rear shielding plates.

(3) In a first example, the exhaust gas flows from one or more air holes of an outer circumferential section of one shielding plate to each filter through a gap in which the outer circumferential surface of the filter serves as an intake surface and the inner circumferential surface thereof serves as an exhaust surface. Then, the exhaust gas flows downstream from one air hole of the central section of the other shielding plate through each central through hole.

In a second example, the exhaust gas flows from one air hole of the central section of the other shielding plate through each central through hole to each filter, in which the inner circumferential surface of the filter serves as an intake surface and the outer circumferential surface thereof serves as an exhaust surface. Then, the exhaust gas flows downstream from one or more air holes of the outer circumferential section of one shielding plate through the clearance.

(4) The particulate matter contained the exhaust gas is burned while being collected on each filter, whereby the filter is regenerated.

(5) The particulate matter reducing apparatus of the present invention has operational advantages as described below (refer to the first to fifth points). First, (a) the filter is set to have a low collection rate, and (b) the filter is regenerated after the particulate matter is burned and eliminated while being collected on the filter. Further, continuous burning of the particulate matter is possible by the wire of which the main component is Fe, which functions as an oxidation catalyst, an oxidation catalyst with which the wire is coated, or a fuel borne catalyst and the like. Thus, continuous regeneration of the filter is possible.

(c) The exhaust gas is dispersed and the particulate matter is evenly collected on the filter because the intake and exhaust surfaces of the filter are formed along the flow of the gas in a large area.

With these (a), (b), and (c), the filter barely reaches a permissible amount and a collection limit. As a result, clogging barely occurs and the frequency of filter cleaning becomes low.

(6) Second, (a) this filter is provided so that the filling density of the wire is 40% or less and a low collection rate is attained. The diameter of the central through hole is almost the same as, or larger than, that of the exhaust pipe and it is also considered to increase the number of superpositions (laminations). (b) Since elimination of the particulate matter is possible by continuous burning thereof, regeneration of the filter is possible. (c) The exhaust gas is dispersed so that the particulate matter is evenly collected.

With these (a), (b), and (c), resistance to the flow of the exhaust gas and pressure loss are also small. As a result, the increase of back pressure on the upstream side is avoided and a bad influence on the diesel engine is also avoided.

(7) Third, the filter is composed of (a) a wire mesh structure of which the diameter of the wire is 0.2 mm or more and is provided to attain a low collection rate. (b) Continuous burning of the particulate matter is possible. (c) The exhaust gas is dispersed to evenly collect the particulate matter.

With these (a), (b), and (c), burning the particulate matter in large quantity at one time to abruptly increase the temperature is avoided. However, continuous and early burning of the particulate matter in small quantity is possible. In this manner, the temperature rise of the filter can be controlled to prevent melting and damage of the filter by heat.

(8) Fourth, this reducing apparatus is composed of a simple structure whereby the filter is retained within the outer cylindrical casing by a pair of shielding plates. Thus, cleaning and the like can be readily carried out.

(9) Fifth, in this reducing apparatus, the filter of a low collection rate is used, but it is also possible to obtain a high reduction and purification rate using the oxidation catalyst and the fuel borne catalyst together.

The particulate matter reducing apparatus according to the present invention is characterized in that one or more filters are adopted in combination with each of the following:

That is, a wire mesh structure; a short column shape with one central Through-hole; a coaxial arrangement within an outer cylindrical casing; a pair of shielding plates with one or more air holes; the diameter and filling density of a wire; a low collection rate; a wire of which the main component is Fe; an oxidation catalyst; a fuel borne catalyst, etc.

The particulate matter reducing apparatus of the present invention exerts the following effects.

<First Effect>

First, the filter is barely clogged and it is possible to minimize the trouble of cleaning. Namely, the filter of the present invention is not a method of a high collection rate as seen in the conventional example of the kind described above, but a method of a low collection rate, wherein the filter is regenerated by burning the particulate matter while collecting. The collected particulate matter can be continuously burned and thus, the filter can also be continuously regenerated.

In particular, the wire of which the main component is Fe, the oxidation catalyst with which the wire is coated, and the fuel borne catalyst are effective for this. Further, since it is evenly collected, the particulate matter is not intensively and biasedly collected differently from the conventional example of the kind described above.

With these, the filter barely reaches its permissible amount and collection limit compared with the conventional example of this kind described above and clogging barely occurs. For example, the frequency of filter cleaning can be decreased because it suffices if the cleaning is carried out about once a week. For the purpose of regenerating the filter, it is not necessary to adopt an electric heater, a heating furnace, an alternately regenerating method or the like. Thus, the filter is also excellent in terms of the cost of equipment and the running cost.

<Second Effect>

Second, the increase of back pressure is controlled to avoid an adverse influence on the diesel engine. Namely, in the filter of the present invention, the filling density of the wire is 40% or lower and a method of a low collection rate is adopted. The diameter of the central through hole is almost the same as or larger than that of the exhaust pipe. It is also possible to increase the number of superpositions (laminations). Further, the particulate matter is burned while being collected. In addition, elimination of the particulate matter is possible by continuously burning it, thereby making it possible to continuously regenerate the filter. Still further, the particulate matter is evenly collected.

With these, resistance to the exhaust gas and the pressure loss are small to avoid the increase of back pressure on the upstream side. Accordingly, excessive load is not imposed on the engine, different from the conventional examples described above. As a result, excessive increase of driving torque and deterioration of fuel consumption can be eliminated. Further, the rate of occurrence and the content (by percentage) of the particulate matter in the exhaust gas do not increase.

<Third Effect>

Third, melting and damage of the filter by heat can be prevented. Namely, the filter of the present invention is composed of a wire mesh structure of which the diameter of the wire is 0.2 mm or more and adopts a method of a low collection rate. The particulate matter is burned while being collected and can be continuously burned. Further, the particulate matter is evenly collected.

A large amount of collected particulate matter is not burned at one time unlike with the conventional examples of this type described above and as a result, an abrupt temperature rise of the filter can be avoided. In this manner, the filter is prevented from melting or being damaged by heat. Thus, it is possible to regenerate the filter for a long time, wherein the durability is good, the life is long, and the cost can also be reduced.

<Fourth Effect>

Fourth, these can be readily realized. Namely, the present invention is composed of a simple structure whereby the filter is retained within an outer cylindrical casing by a pair of shielding plates. Thus, the cost of the present invention is excellent and the maintenance of such a structure is easy because cleaning of the filter can also be readily carried out.

<Fifth Effect>

Fifth, a high reduction and purification rate can also be realized. Namely, in the present invention, by using the oxidation catalyst and/or the fuel borne catalyst together, it is possible to obtain a higher reduction and purification rate of the particulate matter than in a single use of the filter. Namely, a higher reduction and purification rate can be realized in spite of the use of a filter with a low collection rate. Unlike the conventional examples of the type described above, higher reduction and purification rate can be obtained in the conditions in which there is no trouble in cleaning, increase in the back pressure, melting of the filter and the like.

As described above, the problems existing in the conventional examples of this type can be solved by the present invention. Thus, the effects that the present invention can exert are great and remarkable.

BRIEF DESCRIPTION OF THE DRAWING

The above and other objects, features and advantages of the present invention will become more apparent from the following description when taken in conjunction with the accompanying drawings.

FIG. 1 is provided to explain the best mode for providing a particulate matter reducing apparatus according to the present invention, in which

FIG. 2 is provided to explain the best mode for carrying out the same invention as described above, in which

FIG. 3 is provided to explain the best mode for carrying out the same invention as above, in which

FIG. 4 is provided to explain the best mode for carrying out the same invention as above, in which FIG. 5 is an explanatory cross-sectional view of a conventional particulate matter reducing apparatus of this type and the like.

DESCRIPTION OF THE PREFERRED EMBODIMENT

<Exhaust System>

Figure 1A:
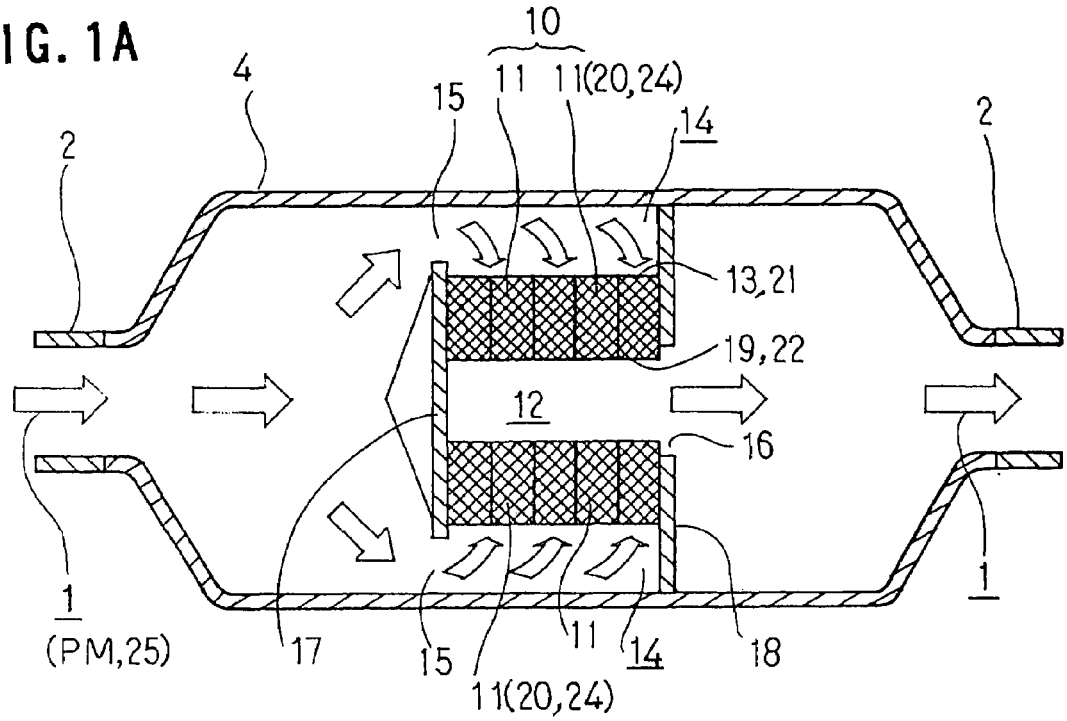
FIG. 1A is an explanatory cross-sectional view of a first example and FIG. 1B is an explanatory cross-sectional view of a second example.

An exhaust system will now be explained with reference to FIG. 3C. A diesel engine 9 is widely used as an internal combustion engine in automobiles, power generation, marine vessels, locomotives, aircraft, various pieces of machinery and the like.

Particulate matter is contained in the exhaust gas 1 discharged from the diesel engine 9. If the particulate matter is directly discharged to the open air, it is harmful to the human body and the environment. Accordingly, a particulate matter reducing apparatus 10 is connected to an exhaust pipe 2. Namely, fuel is supplied from a fuel tank 9' to the diesel engine 9 which discharges the exhaust gas 1 to the exhaust pipe 2. The exhaust gas 1 is discharged to the open air via the particulate matter reducing apparatus 10 connected to the exhaust pipe 2.

The particulate matter reducing apparatus 10 is provided to burn and reduce the particulate matter (hereinafter referred to as "PM") contained in the exhaust gas 1 of such a diesel engine 9 while collecting on a filter 11. The particulate matter reducing apparatus 10 is coaxially housed in an outer cylindrical casing 4 connected to the exhaust pipe 2.

Figure 5:
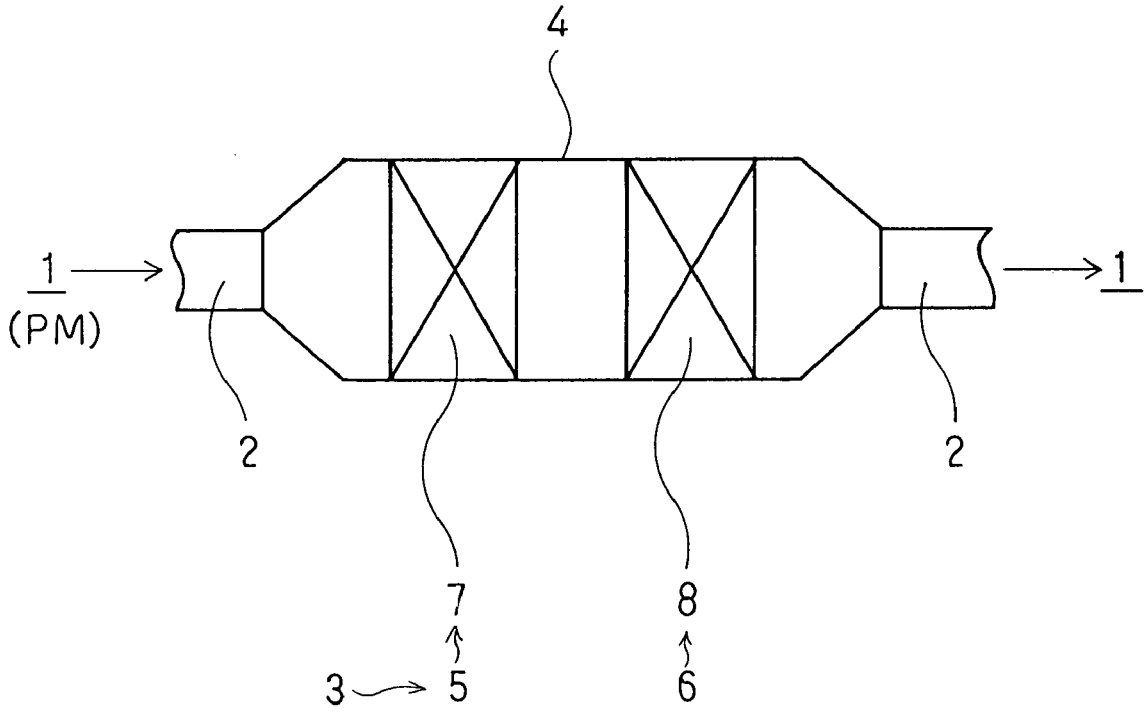

Often housed on the upstream side of the particulate matter reducing apparatus 10 within the outer cylindrical casing 4 is a purifier 5 with an oxidation catalyst 7 (refer to FIG. 5 described above) which burns and reduce, by oxidation, CO, HC, NO and the like as well as the PM contained in the exhaust gas 1 which are regarded as the harmful substance. The purifier 5 and the particulate matter reducing apparatus 10 are sometimes generically named an exhaust gas purifier 3.

The PM is mainly composed of dry soot (black smoke), unburnt HC, lubricating oil HC, sulfate, that is, $SO_4$, and $H_2O$.

The dry soot is so called soot which is burnt embers from incomplete combustion of C. The dry soot and sulfate are components that do not dissolve in a solvent and are also referred to as an "ISF" (Insoluble Fraction) component. These make up about 60% of the PM.

The unburnt HC and the lubricating oil HC are components that dissolve in the solvent and are also referred to as an "SOF" (Soluble Organic Fraction) component. These make up approximately 40% of the PM.

The PM consisting of such components is about the size of several μm in a primary particle condition, but it is usually interconnected in a secondary particle condition of about the size of several 100 μm.

The exhaust system is as described above.

<Outline of Particulate Matter Reducing Apparatus 10>

A particulate matter reducing apparatus 10 of the present invention will now be described in detail with reference to FIGS. 1 through 4.

The particulate matter reducing apparatus 10 is composed of a DPF type in which one or more filters 11 are used. The filter 11 is made of a wire mesh structure and is formed in a short column shape provided with one central through hole 12. The filter 11 is coaxially housed in an outer cylindrical casing 4 connected to an exhaust pipe 2 for the exhaust gas 1. The filter 11 is retained by a pair of shielding plates 17 and 18 with one or more air holes 15 and 16, having a gap 14 provided between the outer circumferential surface 13 of the filter 11 and the outer cylindrical casing 4.

The filter 11 allows the exhaust gas 1 to flow between the inner circumferential surface of the filter 11 on the side of the central through hole 12 and the outer circumferential surface 13 of the filter 11, wherein the collection rate of the PM is set at 50% or less in total.

These are described in detail below. One or more filters 11 of this particulate matter reducing apparatus 10 are composed of a wire mesh structure in which a wire 20 made of minute iron and steel of which the main component is Fe of stainless steel and the like is aggregated in vertically and horizontally minute and dense mesh. Namely, the filter 11 consists of mesh aggregates in which such a metal wire 20 is woven in a fibriform shape such as plain fabric, twilled fabric, stockinette stitch or the like.

Although a plurality of filters is used in many cases, the filter 11 is provided in such a manner that the diameter of the wire 20 is between 0.2 mm and 0.8 mm and the filling density thereof (the cubic volume of the wire 20 per unit volume) (the filling factor of the wire 20, that is, the mesh density) is between 10% and 40% and the collection rate of the PM is between 20% and 50% in total by selection of the number of superpositions corresponding to the quantity of the exhaust gas 1.

Referring to the specifications of the filter 11, in the case where the wire diameter is below 0.2 mm, the filter 11 has low heat resistance during collection and burning of the PM and is in danger of melting, wherein the production cost becomes high. On the contrary, in the case where the wire diameter is 0.8 mm or more, forming of the filter 11 is difficult and the mesh becomes too coarse to excessively reduce the surface area of the filter 11 per unit volume.

In the case where the filling density of the wire 20 is below 10%, the mesh becomes too coarse to make holding of the shape of the filter 11 difficult. On the contrary, in the case where the filling density of the wire 20 is 40% or more, the mesh becomes too dense to increase the pressure loss.

The filter 11 of a wire mesh structure made of such a wire 20 is formed in a short column shape provided with a central through hole 12.

Namely, the filter 11 is provided in such a manner that, for example, the outer diameter (the dimension between the outer circumferential surfaces 13 of the filter 11) is approx 250 mm, the inner diameter (the diameter of one central through hole) (the dimension between the inner circumferential surfaces 19) is approx 90 mm, and the thickness (the linear dimension in the axial direction) is approximately 40 mm. The filter 11 is formed in the short column shape provided with one central through hole 12 of a circular-hole shape. The diameter of the central through hole 12 is close to or larger than that of the exhaust pipe 2 (including the case where the diameter is slightly smaller than that of the exhaust pipe 2 as shown in FIG. 1), but it is smaller than half the outer diameter of the filter 11.

Such a filter 11 is provided in such a manner that in many cases, a plurality of filters, such as 4 or 8 filters, is superposed for lamination while aligning mutually centered through holes 12 in the axial direction, and is coaxially housed in the outer cylindrical casing 4 with each filter axis provided in the longitudinal direction. In this case, the filter 11 is housed in the outer cylindrical casing providing a gap which is a circumferential space between the outer circumferential surface 13 of the filter 11 and the outer cylindrical casing 4. The outer cylindrical casing 4 is formed in a cylindrical shape of a diameter of, e.g., about 300 mm, larger than that of the exhaust pipe 2 and interposed in the middle of the exhaust pipe 2 as shown in the example of FIG. 3C, or connected to the end of the exhaust pipe 2.

The filter 11 is provided, in which the collection rate of the PM is set between 20% and 50% in total in the case where a plurality of filters is used. When the collection rate is below 20%. In the case where the collection rate is below 20%, elimination and reduction of the PM become too small. On the contrary, when the collection rate is 50% or more, clogging is readily generated by the collected PM. As a result, the frequency of cleaning is increased and the filter 11 is also at risk for an increase in back pressure, and melting or damage by heat.

Such a collection rate of the filter 11 is set by selection of the surface area of the filter 11 (the gross area of the entire outer surface of the wire 20 used) obtained by selecting the diameter of the wire 20 and the filling density thereof and the number of superpositions according to the quantity of the exhaust gas 1.

The particulate matter reducing apparatus 10 is provided as outlined above.

<Shielding Plates 17 and 18>

As shown in FIG. 1 and FIG. 2, in this particulate matter reducing apparatus 10, such filters 11 are retained as if they are sandwiched between a pair of front and rear shielding plates 17 and 18 facing one another at a predetermined spacing. The front and rear shielding plates 17 and 18, respectively formed in a circular shape, are made of metal and disposed in the outer cylindrical casing 4 to divide the inside of the casing 4 in front and rear.

The outer circumferential section of one shielding plate 17 is provided with one or more air holes 15 for passage of the exhaust gas 1 which are open to the gap 14 provided between the outer circumferential surface 13 of the filter 11 housed in the outer cylindrical casing 4 and the outer cylindrical casing 4. The central section of the other shielding plate 18 is provided with an air hole 16 for passage of the exhaust gas 1 which is open to the central through hole 12 of the filter 11.

Referring to the air hole 15 formed on the outer circumferential section of the shielding plate 17, a large number of circular holes may be concentrically provided at the same interval or a small number of long holes may be concentrically provided. Further, the air hole 15 may be a plurality of notches formed on the side of the outer cylindrical casing 4.

Figure 2A:
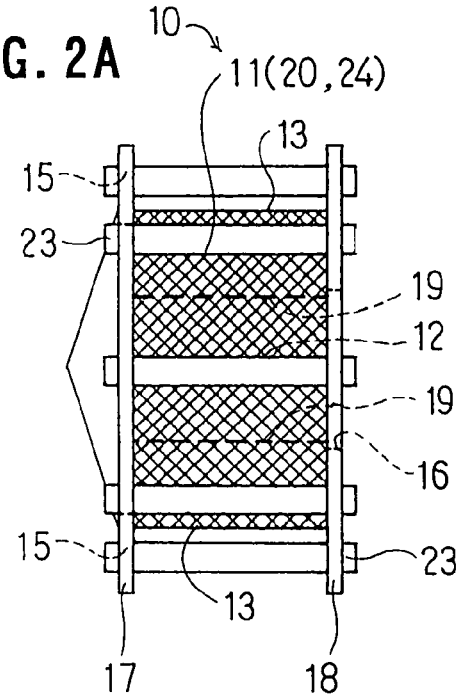
FIG. 2A is an explanatory front view of a substantial part of the first example.
Figure 2B:
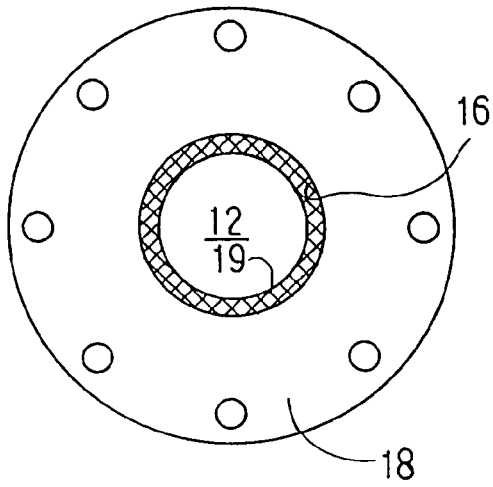
FIG. 2B is an explanatory view of the substantial part of the first example as seen from the right side.

In the first example shown in FIG. 1A, FIG. 2A, and FIG. 2B, the shielding plate 17 is disposed upstream of the flow direction of the exhaust gas 1, while the shielding plate 18 is disposed downstream thereof. In this example, the outer circumferential surface 13 of the filter 11 serves as an intake surface 21 for the exhaust gas 1 and the inner circumferential surface 19 thereof serves as an exhaust surface 22 for the exhaust gas 1. And the exhaust gas 1 flows from the outside to the inside while dispersing within each filter 11, wherein the PM is evenly collected on each filter 11.

Figure 1B:
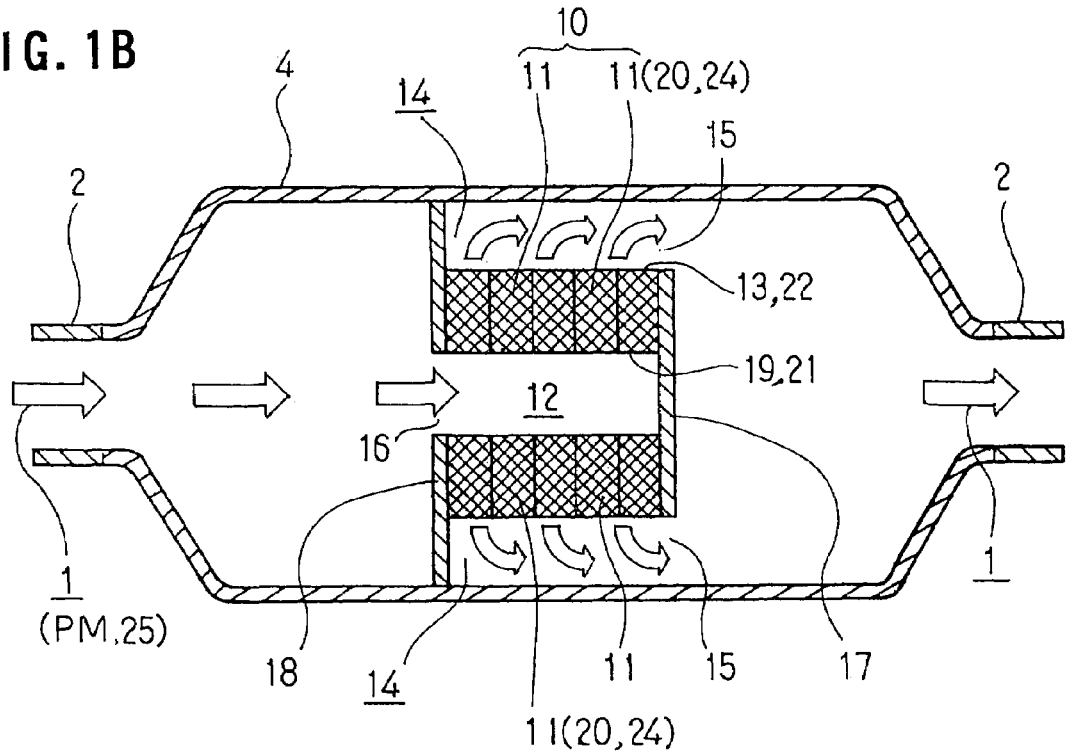
Figure 2C:
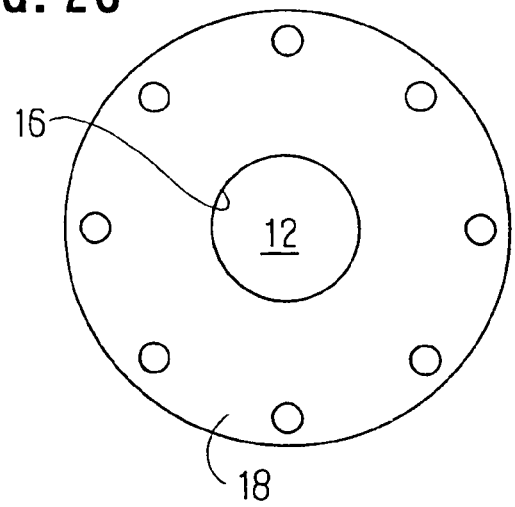
FIG. 2C is an explanatory view of a substantial part of the second example as seen from the left side.
Figure 2D:
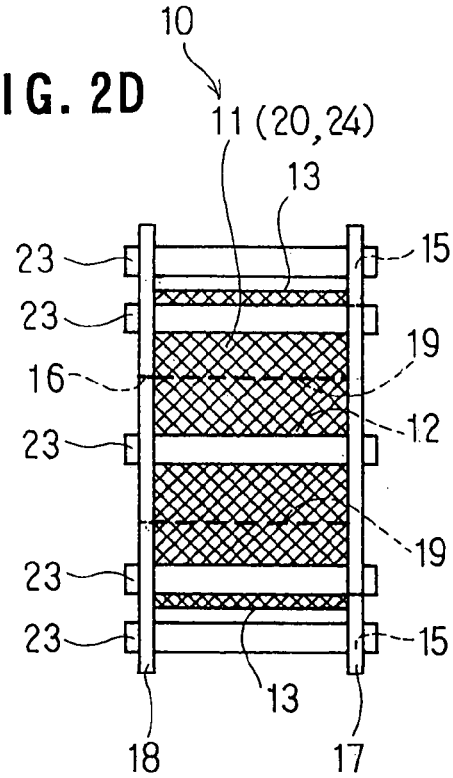
FIG. 2D is a explanatory front view of the substantial part of the second example.

On the contrary, in the second example shown in FIG. 1B, FIG. 2C, and FIG. 2D, the shielding plate 17 is disposed downstream, while the shielding plate 18 is disposed upstream. In this example, the inner circumferential surface of the filter 11 is the intake surface 21 for the exhaust gas 1 and the outer circumferential surface of the filter 11 is the exhaust surface 22 for the exhaust gas 1. The exhaust gas 1 flows from the inside to the outside while dispersing within each filter 11, wherein the PM is evenly collected on each filter 11.

Reference numeral 23 in FIG. 2 is a plurality of nuts and bolts which is axially disposed to enclose the outside of each filter 11. The nuts and bolts are bridged and secured between the shielding plates 17 and 18. In this manner, each filter 11 is positioned and secured while being sandwiched between the shielding plates 17 and 18.

The shielding plates 17 and 18 are provided as described above.

<Catalyst>

A catalyst will now be described. First, the filter 11 of the particulate matter reducing apparatus 10 is made of a wire 20 of which the main component is Fe.

Fe has a function as a catalyst (oxidation catalyst) which promotes oxidation and burning of the collected PM. In particular, it promotes oxidizing and burning of a SOF component consisting of the unburned HC and lubricating oil HC of the components of the PM. For example, the Fe of this wire 20 is capable of burning and eliminating more than 25% of the collected PM by itself.

Each filter 11 as shown in FIG. 1, FIG. 2, FIG. 3A, and FIG. 3B is carried and supported. The surface of the wire 20 is coated with the oxidation catalyst 24 of precious metal via a washcoat. This oxidation catalyst 24 increases the surface area (the gross area of the entire outer surface of the wire 20) of each filter 11 to promote the collection of the PM, thereby promoting oxidizing and burning of the collected PM. For example, $Al_2O_3$, the zeolite thereof or the like is available as the washcoat. As the oxidation catalyst 24, a precious metal such as Pt of approx 40 g/ft$^3$~120 g/ft$^3$ ($1.48\times10^{-3}$ g/cm$^3$~$4.44\times10^{-3}$ g/cm$^3$) is used.

Further, the oxidation catalyst 24 oxidizes NO in the exhaust gas 1 to $NO_2$ in the same manner as the oxidation catalyst 7 described above, but oxidation and burning of the PM is also promoted even by the $NO_2$ obtained in this manner. The oxidation catalyst 24 exerts the function of promoting oxidizing and burning of the collected PM from this aspect.

Figure 3A:
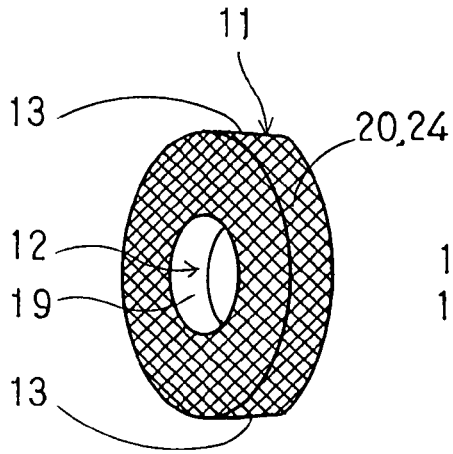
FIG. 3A is a perspective view of one filter.
Figure 3B:
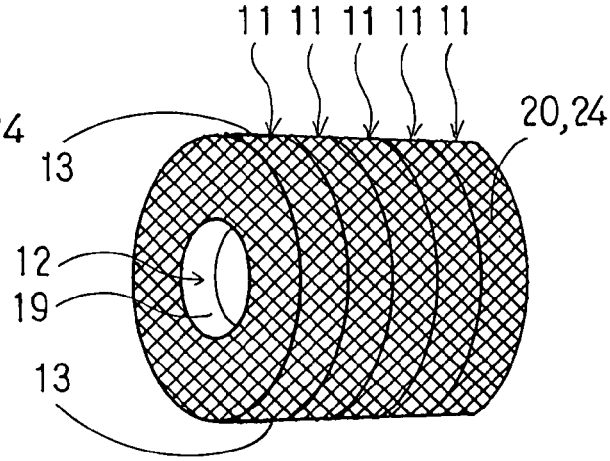
FIG. 3B is a perspective view of a plurality of filters which are superposed (for lamination)
Figure 3C:
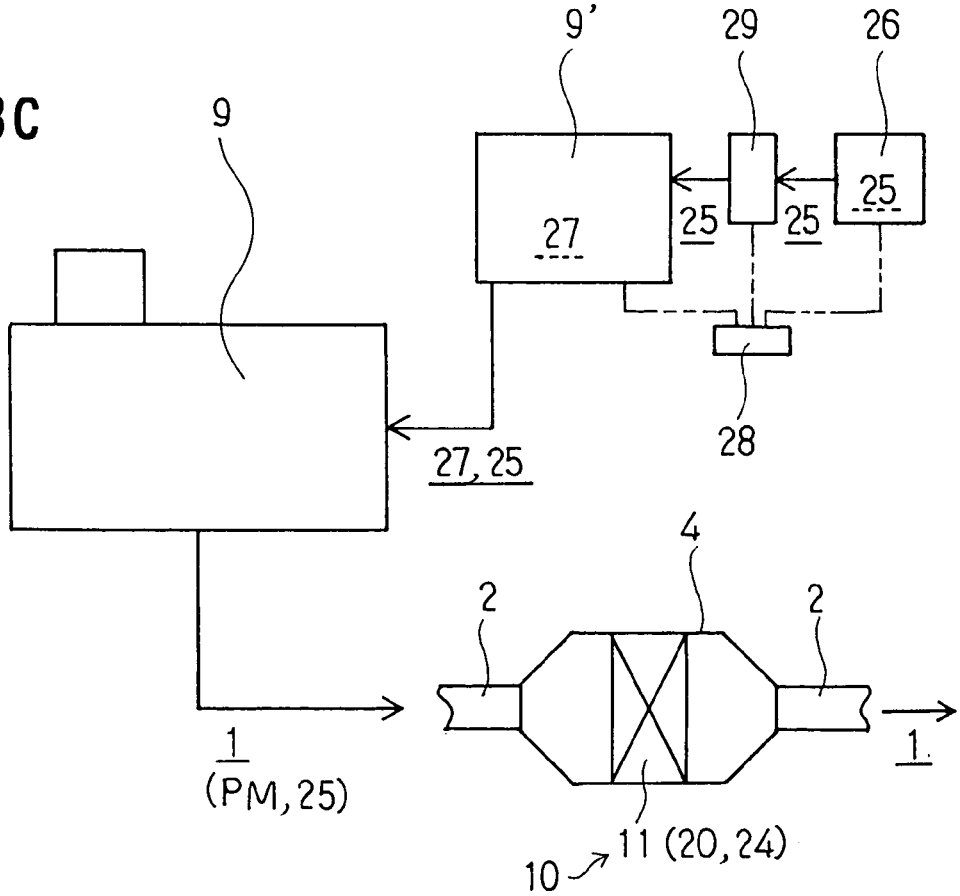
FIG. 3C is a systematic diagram of an exhaust system.

Still further, in the example shown in FIG. 3C, a fuel borne catalyst 25 selected from or combined with Pt, Ce, and Fe can be supplied to a fuel tank 9' of a diesel engine 9. Then, the fuel borne catalyst 25 which has been contained in the exhaust gas 1 promotes oxidizing and burning of the PM collected on the filter 11.

The fuel borne catalyst 25 can be supplied directly to the fuel 27 in the fuel tank 9' from a catalyst tank 26. However, it is desirable to supply the fuel borne catalyst 25 according to the remaining amount of the fuel 27 in the fuel tank 9' using a dosing system shown in FIG. 3C. In this case, data from the diesel engine 9, the particulate matter reducing apparatus 10, and the fuel tank 9' is input to an engine control unit 28, whereby a control signal is output to a dosing pump 29 and the like.

The catalyst is provided as described above.

<Operation etc.>

The particulate matter reducing apparatus 10 of the present invention is constructed as described above. Operation of the apparatus is performed as described below.

(1) The exhaust gas 1 containing the PM from the diesel engine 9 is supplied to the particulate matter reducing apparatus 10 via the exhaust pipe 2 and passes through the filter 11 (refer to FIG. 3C). The filter 11 is made of a wire mesh structure formed from a metal wire 20 and is constructed in the column shape provided with a central through hole 12, whereby a plurality of filters is superposed for lamination (refer to FIG. 3A and FIG. 3B).

(2) Each filter 11 is further constructed as follows. The wire 20 of each filter 11 of which the main component is Fe is coated with the oxidation catalyst 24. The diameter of the central through hole 12 of each filter 11 is close to or larger than that of the exhaust pipe 2, but smaller than half the outer diameter of the filter 11.

Each filter 11 is provided in such a manner that the diameter of the wire 20 is between 0.2 mm and 0.8 mm and the filling density thereof is between 10% and 40%. In each filter 11, the collection rate of the PM is between 20% and 50% in total by the combination selection of the diameter of the wire 20 and the filling density thereof and by the selection of the number of superpositions (laminations) of the filters 11 corresponding to the quantity of the exhaust gas 1.

When a larger value is chosen from the range of the numerical values as the diameter of the wire 20 and a smaller value is chosen from the numerical values as the filling density of the wire 20 to obtain a surface area of the filter 11 necessary for a predetermined collection rate, it is possible to increase the number of superpositions of the filters 11 compared with the case where such a choice is not made. Of course, it should be understood that the number of superpositions (laminations) of each filter 11 is increased or decreased depending on the quantity of the exhaust gas 1.

Such a filter 11 is housed in the outer cylindrical casing 4 connected to the exhaust pipe 2 of the exhaust gas 1 and is retained by a pair of front and rear shielding plates 17 and 18.

(3) In the particulate reducing apparatus provided with such a filter 11, the exhaust gas 1 flows as described below. The first example is shown in FIG. 1A, FIG. 2A, and FIG. 2B.

The exhaust gas 1 is supplied from the exhaust pipe 2 to the inside of the first half section of the outer cylindrical casing 4 and flows to the shielding plate 17 on the upstream side. The exhaust gas 1 then flows to a gap 14 through one or more air holes 15 provided at the outer circumferential section of the shielding plate 17.

Then, the exhaust gas 1 flows through each filter 11 from the outside to the inside while making the outer circumferential surface 13 of the filter 11 an intake surface 21 and making the inner circumferential surface thereof an exhaust surface 22. The exhaust gas 1 flows from each central through hole 12 to the inside of the latter half section of the outer cylindrical casing 4 through one air hole 16 provided at the central section of the shielding plate 18 on the downstream side. The exhaust gas 1 is then discharged to the open air via the exhaust pipe 2.

The second example is shown in FIG. 1B, FIG. 2C, and FIG. 2D.

The exhaust gas 1 is supplied from the exhaust pipe 2 to the inside of the first half section of the cylindrical casing 4 and flows to the shielding plate 18 on the upstream side. The exhaust gas 1 then flows to the central through hole 12 via one central air hole 16 provided at the central section of the shielding plate 18.

The exhaust gas 1 then flows through each filter 11 from the inside to the outside while making the inner circumferential surface 19 of the filter 11 an intake surface 21 and making the outer circumferential surface 13 thereof an exhaust surface 21. The exhaust gas 1 flows from the gap 14 to the inside of the latter half of the outer casing 4 through one or more air holes 15 provided at the outer circumferential section of the shielding plate 17 on the downstream side. The exhaust gas 1 is then discharged to the open air via the exhaust pipe 2.

(4) In both the first and second examples, the exhaust gas 1 flows through each filter 11 as described above, whereby the PM contained in the exhaust gas 1 is simultaneously burned and reduced while being collected on each filter 11. Namely, the PM in the exhaust gas 1 is collected on each filter 11 and then oxidized and burned in order by heat of the exhaust gas 1 soon after collection, wherein the content (by percentage) of the PM in the exhaust gas 1 is reduced.

Each filter 11 is regenerated when the PM collected in this manner is burned and eliminated. In other words, since the PM collected on the surface is eliminated in order, the next new PM can be collected again on the surface. The filter is regenerated again in this manner.

When comparing the first example with the second example, the first example provides better performance in collection, particularly in the vicinity of the wider outer circumferential surface 13 of the filter 11. On the contrary, the second example provides better performance in burning because the PM is more intensively collected, particularly in the vicinity of the inner circumferential surface 19 of the filter 11.

(5) The particulate reducing apparatus 10 of the present invention has such operational advantages as described below (refer to the first to fifth points).

First, each filter of the particulate matter reducing apparatus is made of (a) a wire mesh structure and is set to have a low collection rate of 20% to 50% in total, wherein a comparatively small quantity of PM is collected.

Accordingly, it is difficult for each filter 11 to reach the permissible amount and collection limit. This means that clogging barely occurs and the cleaning frequency of the filter 11 is low.

(b) Each filter 11 is regenerated after burning and eliminating the PM in order while collecting it. Such burning by ignition is based on the heat of the exhaust gas 1 supplied at a high temperature, but burning is further promoted by the wire 20 of which the main component is Fe which functions as a catalyst, the oxidation catalyst 24 with which the wire 20 is coated, and the fuel borne catalyst 25.

Continuous elimination of the PM is possible by continuous burning thereof and thus, continuous regeneration of the filter 11 can be realized. Even from this aspect, it is difficult for each filter 11 to reach the permissible amount and the collection limit, whereby clogging barely occurs and cleaning frequency of each filter 11 is low.

(c) Each filter 11 is formed in a short column shape with one central through hole, is housed in the outer cylindrical casing 4, and is retained by a pair of shielding plates 17 and 18 with one or more air holes 15 and 16.

Each filter 11 is provided in such a manner that the intake and exhaust surfaces 21 and 22 consisting of the outer circumferential surface 13 of the filter 11 and the inner circumferential surface 19 thereof are formed along the flow of the exhaust gas 1 without confronting the flow squarely, and areas of the intake and exhaust surfaces 21 and 22 are also large. Accordingly, since the exhaust gas 1 flows through the inside of each filter 11 while being widely and evenly dispersed therein, the PM is totally and evenly collected on each filter 11. Thus, the PM is not intensively and biasedly collected on a part of each filter 11.

Accordingly, even from this aspect, it is difficult for each filter to reach the permissible amount and the collection limit, whereby clogging barely occurs and the frequency of cleaning of each filter 11 is low.

As described above, each filter 11 can be automatically and continuously regenerated. For the purpose of regeneration of each filter 11, it is not necessary to incorporate an electric heater in or annex a heating furnace to the filter 11 to burn and eliminate the collected PM. It is however possible to use each filter 11 in combination with an electric heater or a heating furnace.

(6) Second, each filter 11 is made of (a) a wire mesh structure of which the filling density of the wire 20 is 40% or less and also has a low collection rate. Further, the diameter of each central through hole 12 is slightly larger than that of the exhaust pipe 2 and is smaller than half the outer diameter of the filter 11 at the maximum. It is also considered to increase the number of superpositions (laminations) of each filter 11 by choosing a larger diameter of the wire 20 and a smaller filling density of the wire 20 from the range of surface area of the filter 11 necessary for a predetermined collection rate.

Therefore, in each filter 11, resistance by friction etc. to the flow of the exhaust gas 1 is small and pressure loss is also small. Accordingly, the increase of back pressure of the exhaust gas 1 is reduced to the minimum or avoided within the exhaust pipe 2 on the upstream side of each filter 11 and this does not have a damaging effect on the diesel engine 9.

(b) Since each filter 11 burns the PM while collecting it at a low collection rate and elimination of the PM by continuous burning is possible, each filter 11 can be continuously regenerated and clogging can also be prevented.

In this manner, each filter has only small resistance to the exhaust gas 1 even from this aspect and the pressure loss is also small. Since an increase in the back pressure is reduced to the minimum or avoided, it does not have an adverse effect on the diesel engine 9.

(c) Each filter 11 is formed in a short column shape with one central through hole, housed in an outer cylindrical casing 4, and retained by a pair of shielding plates 17 and 18. Thus, since intake and exhaust surfaces 21 and 22 have large areas and are formed along the flow of the exhaust gas 1, the exhaust gas 1 flows while being dispersed therein and as a result, the PM is evenly collected on each filter 11.

Accordingly, even from this aspect, resistance of each filter 11 to the exhaust gas 1 is small and the pressure loss is also small, wherein the increase in back pressure can be reduced or avoided. Thus, the filter 11 does not have a damaging effect on the diesel engine 9.

(7) Third, each filter 11 is made of (a) a wire mesh structure of which the diameter of the wire 20 is 0.2 mm or more and of which the main component is Fe. Each filter 11 also has a low collection rate. (b) The PM is simultaneously burned while being collected and continuous burning is also possible. (c) Since each filter 11 is provided with the intake and exhaust surface 21 and 22 of a larger area and is formed along the flow, the exhaust gas 1 flows while being dispersed therein, wherein the PM is evenly collected.

With these (a), (b), and (c), ignition and burning at one time of a large amount of collected PM is avoided and the temperature of the filter 11 abruptly rises. Since the PM is continuously burned in a small quantity and at early stage, the temperature rise of each filter 11 is controlled and as a result, melting or damage by heat can be prevented.

(8) Fourth, these conditions can be readily realized. Namely, this particulate matter reducing apparatus 10 is provided in such a manner that each filter 11 is housed in the outer cylindrical casing 4 and is retained by the pair of shielding plates 17 and 18. Thus, the apparatus 10 can be a simple structure with a small number of parts, wherein maintenance such as cleaning is also simple.

For example, when cleaning is required, each filter 11 can be readily disassembled by releasing the retention thereof by the pair of shielding plates 17 and 18 and then, each filter 11 can be pulled out of the outer casing 4 for easy cleaning.

(9) Fifth, in this particulate matter reducing apparatus 10, although the collection rate of the PM by the filter 11 itself is set to be low at 20% to 50% in total, it is possible to increase the reduction and purification rate of the PM of the entire apparatus by using the oxidation catalyst 24 and/or the fuel borne catalyst 25 together.

Therefore, in spite of the use of the filter 11 with the low collection rate, it is possible to obtain the reduction and purification rates for the entire apparatus higher than the collection rate of the filter 11 itself (that is, the reduction and purification rate higher than that obtained by the filter 11 itself).

In the case where the wire 20 of each filter 11 is coated with the oxidation catalyst 24, it is possible to continuously burn the collected PM, wherein the reduction and purification rate of the entire apparatus can be increased by about 5% to 10%. For example, when the collection rate of the filter 11 is 50%, a reduction and purification rate of about 55% to 60% can be obtained in total (i.e., for the entire apparatus).

Even in the case where the fuel borne catalyst 25 is supplied to the fuel tank 9' of the diesel engine 9, it is possible to further increase the reduction and purification rate of the entire apparatus by approx 5% to 10% compared with the case where only the filter 11 is used because the fuel borne catalyst 25 contained in the exhaust gas 1 functions in the same manner as the oxidation catalyst 24 described above.

Further, when the oxidation catalyst 24 and the fuel borne catalyst 25 are used at the same time, it is possible to further increase the reduction and purification rate of the entire apparatus by approx 10% to 20% compared with the case where only the filter 11 is used. For example, when the collection rate of the filter itself is 50%, reduction and purification rate up to approx 70% can be obtained for the entire apparatus.

In the case of a traffic jam, since the temperature of the diesel engine 9 and the exhaust gas 1 is low, the oxidation catalyst 24 is not activated (because of the low temperature) and the oxidizing and burning promotion function thereof drop. As a result, the reduction and purification rate also goes down, but there is an advantage in that the backpressure increase and melting or damage by heat can be surely prevented.

On the contrary, in a normal run, as the temperature of the diesel engine 9 and the exhaust gas 1 rises, the oxidation catalyst 24 is activated (by the rise of temperature) and a high reduction and purification rate as described above can be obtained.

Embodiment 1

Tests on each embodiment of the particulate matter reducing apparatus 10 according to the present invention are now described below. Tests on the first embodiment will now be described with reference to FIG. 4A.

In this first embodiment, a bench test was conducted for the collection rate using two kinds of filters 11 in which the combination of the diameter of wire 20 and the filling density thereof is different while changing the number of superpositions (laminations) of the filter 11, respectively. The test conditions are as follows.

Shape of each filter 11: outer diameter of 250 mm; inner diameter of 90 mm; and thickness of 40 mm.

Specification of each filter 11: two kinds of filters were used: (1) a filter 11 of which the diameter of the wire 20 is 0.5 mm and the filling density thereof is 25%; (2) a filter 11 of which the diameter of the wire 20 is 0.35 mm and the filling density thereof is 31%.

Type of a diesel engine 9: a normal aspiration engine of V-eight 17 liter capacity was used.

Fuel 27: low-sulfur light oil was used (Sulfur of 50 ppm)

Test mode: 13 modes

Figure 4A:
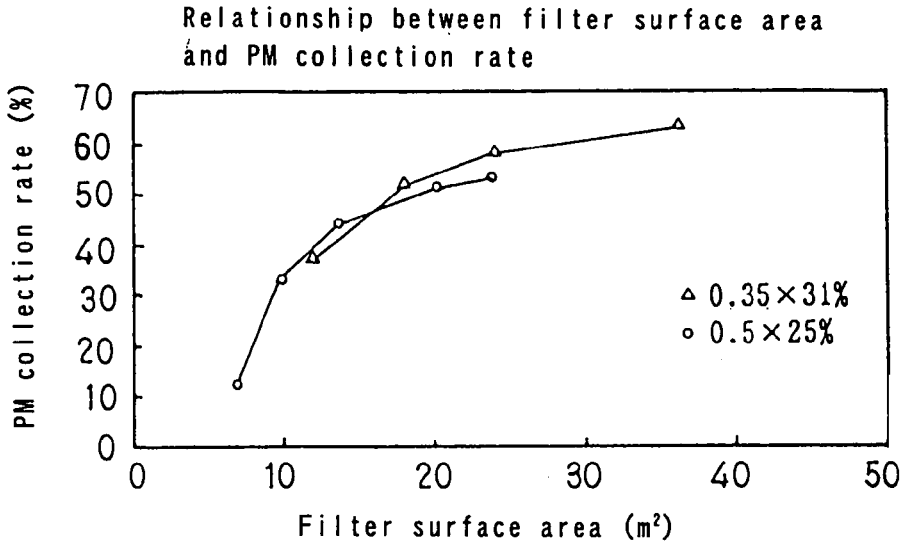
FIG. 4A is a graph showing the relationship between the filter surface area and the collection rate of particulate matter.

As a result of tests under the above conditions, the measurement results as shown in FIG. 4A were obtained, whereby it was verified that the collection rate depends on the surface area of the filter 11 (selection of wire diameter and wire filling density and selection of the number of superpositions).

For example, the filter surface area necessary to obtain a collection rate of 50% is approximately 18 $m^2$ and a filter surface area of approximately 1 $m^2$ was adequate for one liter of the exhaust gas 1. Of course, the necessary filter surface area changes if the shape of the filter 11 changes.

Embodiment 2

Tests on the second embodiment will now be described with reference to FIG. 4B. In this second embodiment, a bench test was conducted for a pressure loss using three kinds of filters 11 in which the combination specification of the diameter of the wire 20 and the filling density thereof differs while changing the number of superpositions (laminations), respectively. Test conditions are based on the first embodiment.

Figure 4B:
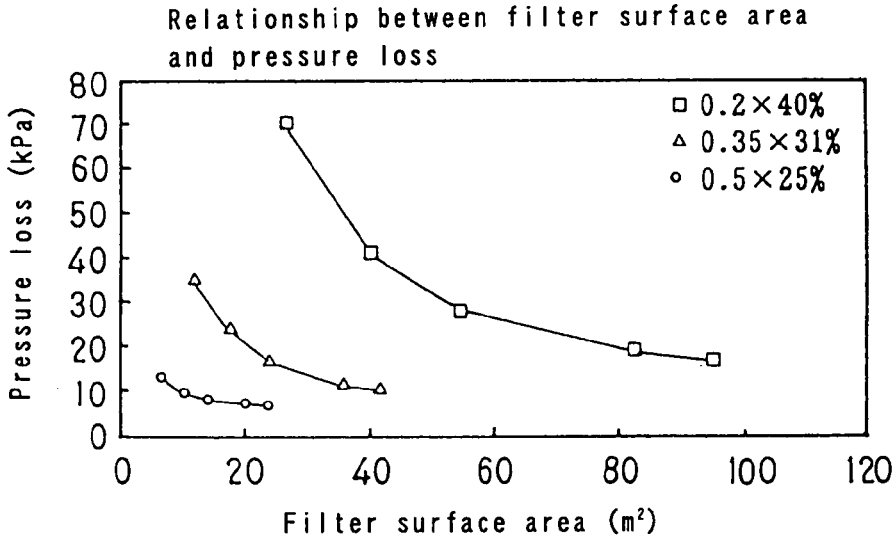
FIG. 4B is a graph showing the relationship between the filter surface area and the pressure loss.

As a result, the measurement results as shown in FIG. 4B were obtained, whereby it was verified that the pressure loss varies with the specification of each filter 11 used even in the case of the same filter surface area. In other words, when the diameter of the wire 20 and the filling density thereof differ, the cubic volume of the filter 11 differs and thus, the pressure loss was different.

For example, in the case where two filters 11 of which the diameter of the wire 20 is 0.35 mm and the filling density thereof is 31%, were used, the surface area of the filters 11 is 12.12 $m^2$. On the contrary, in the case where 3.6 filters 11 of which the diameter of the wire 20 is 0.5 mm and the filling density thereof is 25%, were used, the surface area of the filter 11 is the same as above (12.12 $m^2$).

In this case, since the latter has a wider flow passage of the exhaust gas 1 and a smaller resistance by the difference of 1.6 filters compared with the former, the pressure loss becomes small. In this manner, when a specific filter surface area is required to obtain a certain collection rate, it is desirable that the filter 11 of which the diameter of the wire 20 is thick and large and the filling density thereof is small be chosen from the viewpoint of the pressure loss.

Embodiment 3

Tests on the third embodiment will now be described with reference to FIG. 4C. In this third embodiment, a bench test was conducted for the reduction and purification rate (the collection rate) using one kind of filter 11 in the cases where only the filter 11 is used, where the filter 11 is used with the oxidation catalyst 24, and where the filter 11 is used with the oxidation catalyst 24 and the fuel borne catalyst 25 together, respectively, while changing the number of superpositions (laminations) of the filter 11. The test conditions are based on the first and second embodiments described above.

Figure 4C:
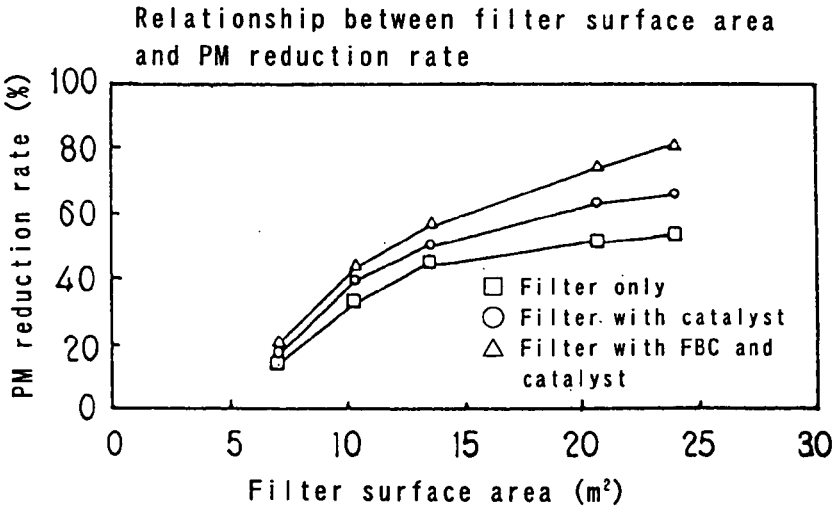
FIG. 4C is a graph showing the relationship between the filter surface area and the reduction rate of the particulate matter.

As a result, the measurement results as shown in FIG. 4C were obtained. In each case, the more the number of superpositions and the wider the surface area of the filter 11, the higher the reduction and purification rate (the collection rate). When observed in the range of a collection rate (reduction and purification rate) of 20% to 50% in the case where only the filter 11 is used, it was verified that the reduction and purification rate was increased by approx 5% to 10% when used with the oxidation catalyst 24, and was increased by approx 10% to 20% when used with the oxidation catalyst 24 and the fuel borne catalyst 25 together.

What is claimed is:

1. A particulate matter reducing apparatus for burning and reducing particulate matter contained in exhaust gas of a diesel engines, while collecting the matter on the apparatus, which comprises: at least one filter for collecting the particulate matter thereon, the filter being comprised of a plurality of wire mesh filter elements wherein the wire mesh is superposed on itself in a plurality of layers, each being formed in a column shape and provided with a central through hole, the filter elements having their central holes being axially aligned and the plurality of filter elements being coaxially housed in an outer cylindrical casing for connection to an exhaust pipe for the exhaust gas, and the filter being releasably retained between a pair of shielding plates having one or more air holes while having a gap provided between the outer circumferential surface of the filter and the outer cylindrical casing, the pair of shielding plates dividing the inside of the outer cylindrical casing in front and rear, respectively, an outer circumferential section of one shielding plate being provided with one or more of said air holes communicating with the gap, while a central section of the other shielding plate is provided with a center air hole communicating with the central through holes of the filter elements, and the filter causing the exhaust gas to flow between the outer and inner circumferential surfaces thereof, wherein one of said shielding plates is upstream and the other of said shielding plates is downstream relative to flow of the exhaust gas, an outer circumferential surface of the filters serves as an intake surface of the exhaust gas and an inner circumferential surface thereof serves as an exhaust surface of the exhaust gas, and the exhaust gas flows through the filters from the outside to the inside thereof, whereby the particulate matter is evenly collected on each of the filters, at a predetermined collection rate of particulate matter of from 20 to 50% in the absence of a catalyst in total by a combination of selection of wire diameter, wire mesh filling density and the number of filter layers of wire mesh in the filter elements, wherein each of the filters is provided with a filter surface area necessary for the predetermined collection rate relative to the quantity of exhaust gas; wherein the structure of wire mesh of each of the filter elements is comprised of mesh aggregates of a metal wire, the filter elements are regeneratable by burning and eliminating the particulate matter collected thereon, the wire of each of the filter elements has a diameter of from 0.2 mm to 0.8 mm, and the filling density of each of the filters being from 10% to 40%.

2. The particulate matter reducing apparatus according to claim 1, wherein each of the filters has a central through hole of a diameter approximately the same as or greater than that of the exhaust pipe and smaller than half the outer diameter of the filter.

3. The particulate matter reducing apparatus according to claim 1, wherein one of said shielding plates is upstream and the other of said shielding plates is downstream relative to flow of the exhaust gas, an outer circumferential surface of the filters serves as an intake surface of the exhaust gas and an inner circumferential surface thereof serves as an exhaust surface of the exhaust gas, and the exhaust gas flows through the filters from the outside to the inside thereof, whereby the particulate matter is evenly collected on each of the filters.

4. The particulate matter reducing apparatus according to claim 1, wherein said one shielding plate is downstream and said other shielding plate is upstream relative to flow of the exhaust gas, an inner circumferential surface of the filter serves as an intake surface of the exhaust gas and an outer circumferential surface thereof serves as an exhaust surface of the exhaust gas, and the exhaust gas flows through each of the filters from the inside to the outside, whereby the particulate matter is evenly collected on each of the filters.

5. The particulate matter reducing apparatus according to claim 1, wherein the main component of the wire of each of the filters is Fe and promotes burning of the collected particulate matter by the Fe functioning as an oxidation catalyst.

6. The particulate matter reducing apparatus according to claim 5, wherein the surface of the wire is coated with an oxidation catalyst comprised of precious metal, and the oxidation catalyst increases the filter surface area to promote the collection of the particulate matter on each of the filters and promotes burning of the particulate matter collected on each of the filters.

7. The particulate matter reducing apparatus according to claim 5 in combination with a diesel engine and a fuel tank for the diesel engine, and fuel in the fuel tank, the fuel containing a catalyst adapted to be caffied by the exhaust gas, the catalyst promoting burning of the particulate matter collected on each of the filters.

* * * * *